United States Patent [19]

Fromm

[11] Patent Number: 4,653,897

[45] Date of Patent: Mar. 31, 1987

[54] LOW MASS CONFORMABLE HEAT AND PRESSURE FUSER

[75] Inventor: Paul M. Fromm, Rochester, N.Y.

[73] Assignee: Xerox Corporation, Stamford, Conn.

[21] Appl. No.: 685,877

[22] Filed: Dec. 24, 1984

[51] Int. Cl.[4] ..... G03G 15/20; H05B 3/02

[52] U.S. Cl. ..... 355/3 FU; 219/216; 219/469; 432/60

[58] Field of Search ..... 355/3 FU, 14 FU; 219/216, 469, 470; 432/60

[56] References Cited

U.S. PATENT DOCUMENTS

| | | | |
|---|---|---|---|
| 3,942,887 | 3/1976 | McCarroll | 355/3 FU |
| 3,964,431 | 6/1976 | Namiki | 118/60 |
| 4,001,544 | 1/1977 | Heinzer et al. | 219/216 |
| 4,188,109 | 2/1980 | Idenawa et al. | 355/3 FU |
| 4,200,389 | 4/1980 | Matsui et al. | 355/3 FU |
| 4,212,631 | 7/1980 | Franke et al. | 219/216 X |
| 4,259,920 | 4/1981 | Sasaki | 118/116 |
| 4,269,594 | 5/1981 | Umans et al. | 355/3 FU X |
| 4,290,691 | 9/1981 | Giorgini | 355/3 FU |

FOREIGN PATENT DOCUMENTS

| | | | |
|---|---|---|---|
| 2027640 | 2/1980 | United Kingdom | 355/3 FU |

*Primary Examiner*—Fred L. Braun

[57] ABSTRACT

Heat and pressure fusing apparatus having a thin-walled tubular fuser roll cooperating with a rigid pressure roll to pass copy substrates therebetween with the toner images on the substrates contacting the fuser roll. The rolls are supported in pressure engagement such that the axes are skewed relative to each other to compensate for roll deflection aggravated by hoop deflection of the thin-walled fuser roll. Thermal degradation of the elastomeric conformable coating is reduced by standing by at a low temperature and quickly warming up to run temperature.

6 Claims, 3 Drawing Figures

LOW MASS CONFORMABLE HEAT AND PRESSURE FUSER

BACKGROUND OF THE INVENTION

This invention relates to xerographic apparatus, and more particularly, it relates to the heat and pressure fixing of particulate, thermoplastic toner by direct contact with a heated fusing member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to elevate the temperature of the toner material to a point at which the constituents of the toner material coalesce and become tacky while simultaneously applying pressure. The action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

One approach to heat and pressure fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby to effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner liguify and cause a splitting action in the molten toner resulting in "hot offset." Splitting occurs when the cohesive forces holding the viscous toner mass together are less than the adhesive forces tending to offset it to a contacting surface such as a fuser roll.

Occasionally, however, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commenly referred to as "offsetting," has been to provide a fuser roll with an outer surface or covering of polytetrafluoroethylene, known by the trade name, Teflon to which a release agent such as silicone oil is applied, the thickness of the Teflon being on the order of several mils and the thickness of the oil being less that 1 micron. Silicone based oils, (polydimethylsiloxane), which possess a relatively low surface energy, have been found to be materials that are suitable for use in the heated fuser roll environment where Teflon constitutes the outer surface of the fuser roll. In practice, a thin layer of silicon oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

A fuser roll construction of the type described above is fabricated by applying in any suitable manner a solid layer of abhesive material such as the solid Teflon outer surface or covering of the aforementioned arrangement to a rigid core or substrate.

In attempts to improve at least the perceived quality of the image fused or fixed by a heated roll fuser, such rolls have been provided with conformable surfaces comprising an elastomeric material such as silicone rubber or Viton (trademark of E. I. DuPont for a series of fluoroelastomers based on the copolymer of vinylidene fluoride and hexafluoropropylene). As in the case of the Teflon coated fuser roll release fluids such as silicone based oils have been applied to the surface of the silicone rubber or Viton to both minimize offsetting and to facilitate stripping. See, for example U.S. Pat. No. 3,964,431.

Commerical heat and pressure roll fusers having an outer conformable covering comprising an elastomer such as silicone rubber adhered to a cylindrical core conventionally utilize a core with a wall thickness on the order of 0.5 inch. In order to render the outer elastomeric covering highly conformable, it is made relatively thick. Characteristically, such fusers have a very slow response time (i.e. the time required to raise the surface temperature back to the fusing temperature after fusing of a copy). Consequently, the core temperature must be maintained at at very high temperature for long periods of time, for example, during the standby mode of fuser operation. This requirement of high temperature for prolonged periods of time leads to shortened useful life of the elastomeric outer covering.

Moreover, even though the core is maintained at a relatively high temperature, there are delays in the copy making process due to the slow fuser response time.

BRIEF SUMMARY OF THE INVENTION

As may be appreciated, a conformable heat and pressure fuser in which degradation of the conformable surface material is substantially eliminated and the waiting time for making copies is minimized is most desirable.

Accordingly, I have, as will be discussed hereinbelow in greater detail, provided a conformable heat and pressure fuser wherein the heated fuser roll structure comprises a low mass member having an internal heat source. To this end, I have provided a tubular core member haing a wall thickness in the order of 0.010–0.016 inch and having a conformable elastomeric layer adhered to the surface thereof. High loading is required so that the elastomeric surface will conform to the paper roughness. Thus, I have fabricated the tubular core from stainless steel to withstand the high stresses to which it is subjected under loading.

When using a low mass tubular fuser with a rigid pressure roll with their axes being parallel to each other, non-uniform fusing and paper waviness perpendicular to paper movement occurs. I discovered that such a thin-walled fuser member undergoes excessive beam deflection due to hoop deflection (i.e. tubular core becomes distorted from a circular cross section to an oval cross section. I discovered that uniform fusing could be obtained without inducing waviness into the paper. I accomplished the foregoing by orienting the roll axes at a skewed relationship to each other. I found unexpectedly that the beam deflection of the tublar fuser member was greater then conventional thicker-walled fuser members. To compensate for the additional flexing, I provided a greater degree of skewing between the rolls to compensate for the expected flexing as well as the unexpected flexing, the latter of which is caused by the hoop deflection.

Skewing of fuser rolls having "thick" walled cores was known as illustrated in U.S. Pat. Nos. 4,259,920; 4,200,389; 4,188,109 and 4,290,691. However, no prior art of which I am familiar recognizes the source of the problem (i.e. non-uniform images and wavy copy sheets attributable to hoop deflection of a thin-walled fuser roll).

The invention and its advantages will become more apparent in the detailed description of the preferred embodiment presented hereinbelow.

DETAILED DESCRIPTION OF THE DRAWINGS

In the detailed description of the drawings, reference is made to the accompanying drawings in which.

DETAILED DESCRIPTION OF THE PREFERRED EMBODIMENT OF THE INVENTION

Figure 1:
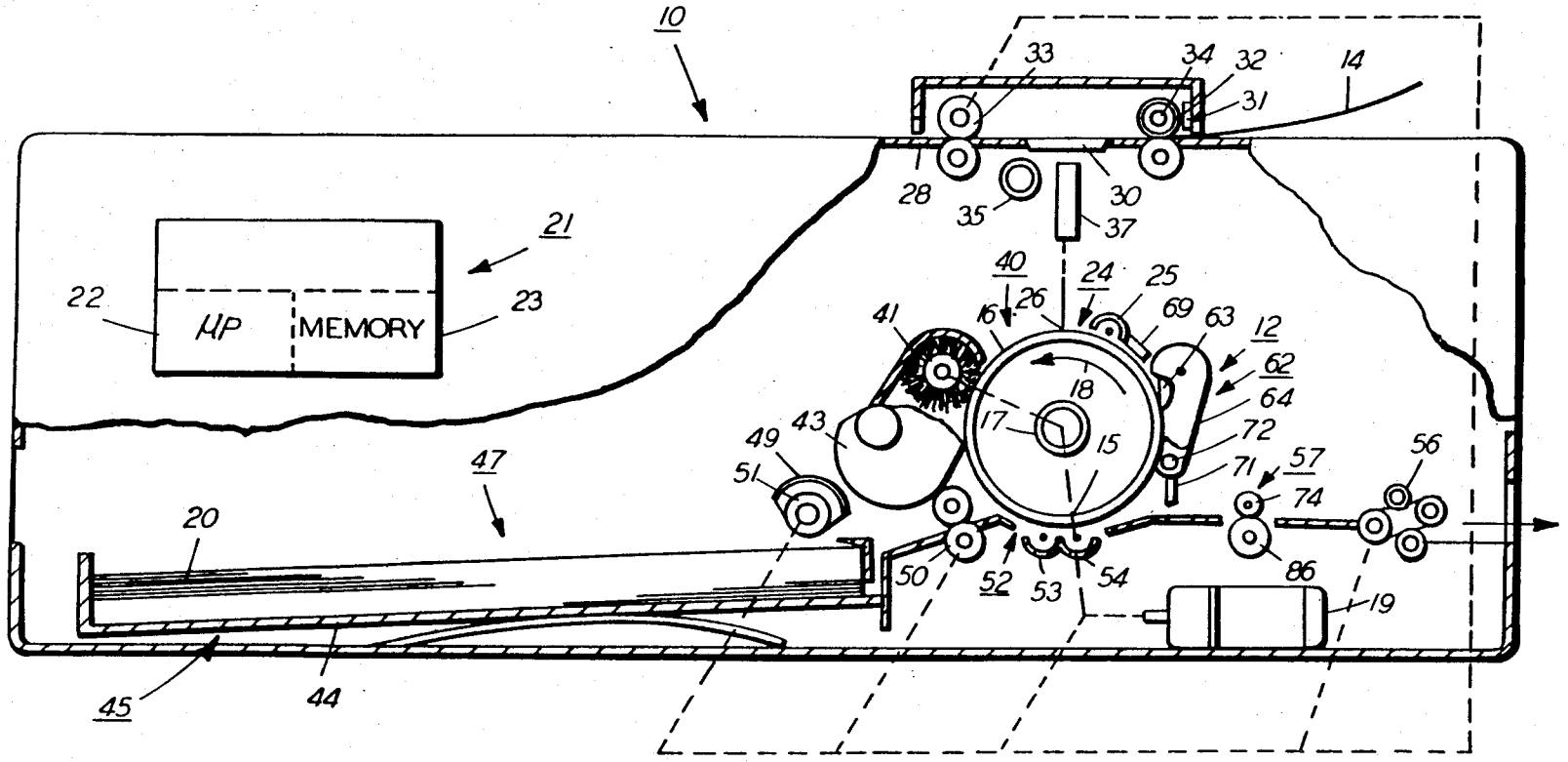
FIG. 1 is a side elevational view depicting a xerographic reproduction machine of the type adapted to incorporate the present invention.

Referring to FIG. 1 of the drawings, there is shown by way of example an automatic xerographic reproduction or printing machine, designated generally by the numeral 10.

The reproduction machine 10 depicted in FIG. 1 illustrates the various components utilized in machines of this type for producing copies of a document original 14. Although the device 12 of the present invention is particularly well adapted for use in reproduction machine 10, it should become evident from the following description that it is equally well suited for use in a wide variety of other reproduction and printing machine types and systems and is not necessarily limited in application to the particular embodiment of embodiments shown herein.

Reproduction machine 10 has an image recording photoreceptor 15 in the form of a drum, the outer periphery of which has a suitable photoconductive material 16. Photoreceptor 15 is suitably journaled for rotation within the machine frame (not shown) as by means of shaft 17. A main drive motor 19 is drivingly coupled to photoreceptor 15, motor 19 rotating photoreceptor 15 in the direction indicated by arrow 18 to bring the photoconductive surface 16 of photoreceptor 15 past a series of xerographic processing stations. A suitable controller 21 with microprocessor 22 and memory 23 is provided for operating in predetermined timed relationship the various components that comprise machine 10 to reproduce the document original 14 upon a sheet of final support material such as copy sheet 20. As will be understood by those familiar with the art, memory 23 may comprise suitable read only memory (ROM), random access memory (RAM), and/or non-volatile memory (NVM), memory 23 serving to store the various operating parameters for reproduction machine 10 and the copy run information programmed by the machine user or operator.

Initially, the photoconductive surface 16 of photoreceptor 15 is uniformly charged by a suitable charging device such as scorotron 25 at charging station 24. The uniformly charged photoconductive surface 16 is exposed at exposure station 26 to create a latent electrostatic image of the document original 14 on photoreceptor 15. For this purpose, a suitable supporting surface or platen 28 for document original 14 is provided having a scan aperture or slit therethrough. A suitable document transport, depicted herein as inlet and outlet constant velocity roll pairs 32, 33 is provided for transporting the document original past scan slit 30. Roll pairs 32, 33 are drivingly coupled to main drive motor 19, roll pair 32 being coupled through an electromagnetically operated clutch 34. A suitable document sensor 31 is provided at the inlet to platen 28 for sensing the insertion of a document original 14 to be copied and initiating operation of the reproduction machine 10.

A lamp 35, which is disposed below platen 28, serves to illuminate scan slit 30 and the line-like portion of the document original 14 thereover. A suitable fiber optic type lens array 37, which may, for example, comprise an array of gradient index fiber elements, is provided to optically transmit the image ray reflected from the line-like portion of the document original being scanned to the photoconductive surface 16 of photoreceptor 15 at exposure station 26.

Following exposure, the latent image of the photoconductive suface 16 of photoreceptor 15 is developed at a development station 40. There, a suitable developer such as magnetic brush roll 41, which is drivingly coupled to main drive motor 19, brings a suitable developer mix in developer housing 43 into developing relation with the latent image to develop the image and render the same visible.

Copy sheets 20 are supported in stack-like fashion on base 44 of copy sheet supply tray 45. Suitable biasing means are provided to raise base 44 of tray 45 and bring the topmost copy sheet 20 in the stack of sheets 47 into operative relationship with segmented feed rolls 49. Feed rolls 49 are driven by main drive motor 19 through an electomagnetically operated clutch 51. Rolls 49 serve upon actuation of clutch 51 to feed the topmost copy sheet forward into the image on the photoconductive surface 16 of photoreceptor 15. Registration roll pair 50 advance the copy sheet to transfer station 52. There, suitable transfer/detack means such as transfer/detack corotrons 53, 54 bring the copy sheet into transfer relation with the developed image on photoconductive surface 16 and separate the copy sheet therefrom for fixing and discharge as a finished copy.

Following transfer station 52, the image bearing copy sheet is transported to fuser 57 where the image is permanently fixed to the image bearing copy sheet. Following fusing, the finished copy is transported by roll pair 56 to a suitable receptacle such as an output tray (not shown). Registration roll pair 50 and transport roll pair 56 are driven by main drive motor 19 through suitable driving means such as belts and pulleys.

Figure 2:
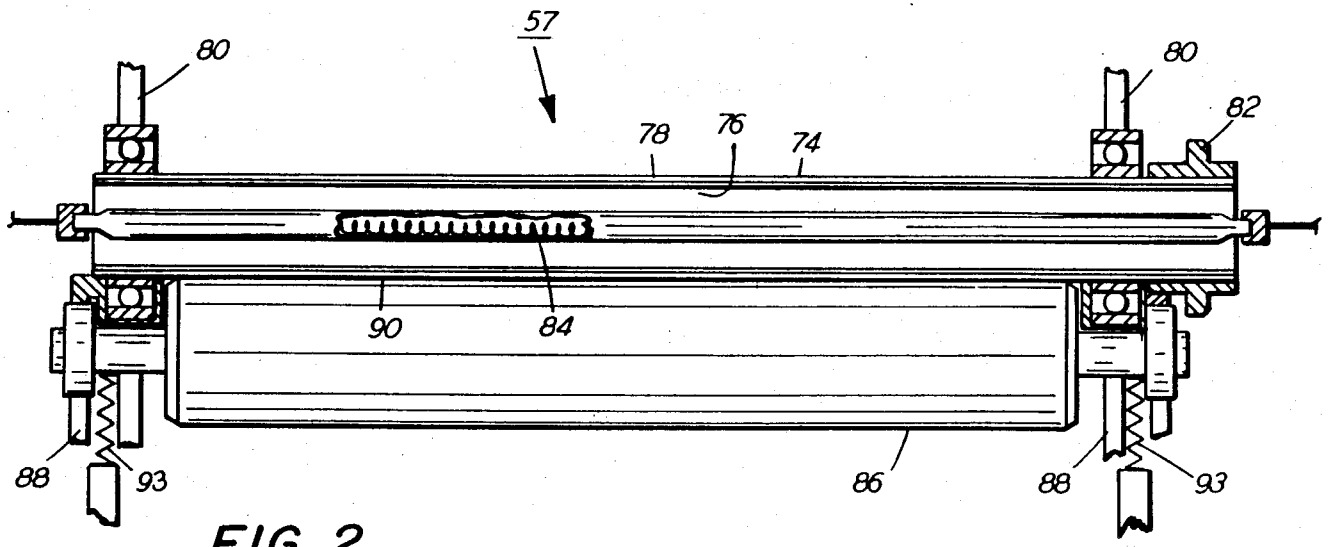
FIG. 2 is a front elevational view of one embodiment of a fuser aparatus incorporating the inventive features of the invention.

Following transfer, residual developer remaining on the photoconductive surface 16 of photoreceptor 15 is removed at cleaning station 62 by means of cleaning blade 63 (FIG. 2). Developer removed by blade 63 is deposited into a suitable collector 64 for removal.

While a drum type photoreceptor is shown and described herein, it will be understood that other photoreceptor types may be employed such as belt, web, etc.

To permit effective and controlled charging of the photoconductive surface 16 by scorotron 25 to a predetermined level necessitates that any residual charges on the photoconductive surface 16 or trapped in the photoreceptor be removed prior to charging. An erase device 69 is provided for this purpose.

At the cleaning station 62, the cleaning blade 63 is supported in contact with the photoreceptor 15 such that residual toner is chiselled therefrom.

The toner and debris that are removed from the photoreceptor 15 fall into the collector 64 and are transported by means of an auger 72 disposed in the bottom of the collector 64. It is moved toward the back of the machine where it falls through an opening in the bottom of the collector 64. The residual toner and debris fall downwardly via conduit 71 into a receptacle (not shown) which serves to store the residual toner until the receptacle is full after which it is removed from the machine.

The inventive aspects of our invention will become apparent from a detailed discussion of FIG. 2.

The fuser apparatus 57, as viewed in FIG. 2, comprises a fuser roll 74 comprising a tubular core member 76 having a layer or coating of an elastomeric material 78 adhered thereto. Suitable elastomeric materials are silicone rubber and Viton (trademark of E. I. DuPont). The wall thickness of the core is in the order of 0.010 to 0.016 of an inch. The core material preferably comprises stainless steel. The thickness of the elastomeric layer is in the order of 0.005 to 0.010 of an inch. The fuser roll is rotatably supported in machine frame members 80 and has a drive gear 82 affixed to one end thereof for effecting rotation of the fuser roll. The gear forms part of a conventional drive train (not shown) forming a part of the machine. The surface of the fuser roll is elevated to standby and fusing temperatures by means of a quartz heater 84 adapted to elevate its filament the fuser roll to its steady-state temperature in less than a second. Such heaters are well known in the art. For example, the Xerox 3100 (trademark of Xerox Corporation) utilizes such a heater. The core, elastomeric layer and heater form a relatively low mass fuser having a relatively fast (i.e. approximately 7–10 seconds to go from room temperature to run temperature) response time. In operation the heater during standby elevates the fuser roll surface to a temperature of approximately 270°–300° F. and to a temperature of approximately 370° F. during fusing or the run mode of operation.

The fuser roll 74 has a length in the order of 10 to 12½ inches and an outside diameter of approximately 1.0 inch. A pressure roll 86 supported by frame members 88 is adapted to be pressure engaged with the fuser roll to form an extended nip 90 through which copy substrates carrying toner images are passed with the images contacting the elastomeric layer 78. Loading is provided through springs 93 which act to move the pressure roll upwardly into pressure engagement. Loading is designed to produce in the order of 10 to 12 pounds per linear inch between the rolls and approximately 50–70 pounds per square inch. It has in the order of 0.040–0.15″ of rubber coating the core. The rubber is compressed by the fuser roll and forms a contact area or nip with the fuser roll. The pressure roll has a diameter of approximately 1.0 inch and is a relatively rigid structure. It has in the order of 0.040–0.15 inch of rubber coating the core. The rubber is compressed by the fuser roll and forms a contact area or nip with the fuser roll. The pressure roll core may be solid shaft or a hollow cylinder of aluminum or steel. As a cylinder, it has a wall thickness of approximately 0.070 of an inch.

Figure 3:
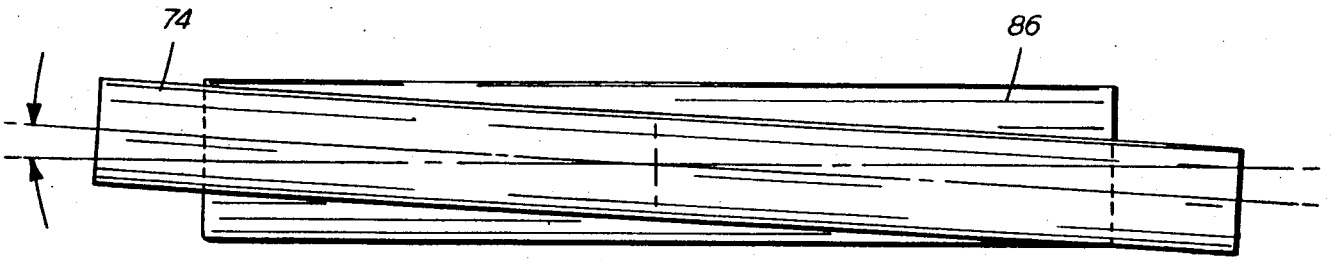
FIG. 3 is a top plan view of the fuser apparatus depicted in FIG. 2.

As viewed in FIG. 3, the fuser roll 74 and pressure roll 86 are mounted such that the longitudinal axes are skewed in the order of 1 to 3 angular degrees. As noted hereinbefore, skewing of the rolls compensates for roll deflection aggravated by hoop deflection of the tubular fuser roll. Otherwise, such deflection would result in a non-uniform nip and would induce wrinkles into and distortions of the copy substrate.

It can now be appreciated that there has been disclosed a low mass heat and pressure fuser requiring a relatively short period of time (3 seconds and/or the time required for the machine to make the copy) to elevate the fuser roll surface from a relatively low standby temperature to the required fusing temperature. Thus, the elastomeric surface adhered which degrade over time at high temperature to the tubular core of the fuser roll is not subjected to the prolonged high temperature as in prior art devices. Moreover, since the fuser of the present invention has a fast response time, delays normally inherent in the copying process such as morning warm-up time and droop recovery are minimized.

I claim:

1. Heat and pressure fusing apparatus for fixing toner images to copy substrates, said apparatus comprising:

a thin-walled, tubular fuser roll having a wall thickness of about approximately in the range of 0.010 to 0.018 inches;

a conformable layer adhered to the outer surface of said fuser roll;

means supported internally of said fuser roll for elevating the temperature thereof;

a rigid pressure roll;

means for supporting said fuser roll and said pressure roll in a pressure engagement suitable for deforming said conformable layer to conform to paper roughness, and such that the axes of said rolls are skewed relative to each other.

2. Apparatus according to claim 1 wherein said axes are angularly skewed to a degree sufficient to compensate for roll deflection aggravated by hoop deflection of said fuser roll.

3. Apparatus according to claim 1 wherein the load created on said rolls by said supporting means is in the order of 10 to 12 pounds per linear inch.

4. Apparatus according to claim 3 wherein the length of said fuser roll is in the order of 10–12½ inches.

5. Heat and pressure fusing apparatus for fixing toner images to copy substrates, said apparatus comprising:

a relatively low mass tubular fuser roll having thin walls and a deformable circular cross section;

a conformable layer on the exterior of said fuser roll;

means supported internally of said fuser roll for elevating the temperature thereof;

a rigid pressure roll;

means for fixedly supporting said fuser roll and said pressure roll in pressure engagement suitable for deformation of said conformable outer layer, with said fuser roll lngitudinal axis and said pressure roll longitudinal axis being slightly skewed relative to each other.

6. The apparatus as defined in claim 5 wherein the angle between said axes is approximately in the range between 1 and 3 angular degrees.

* * * * *